United States Patent [19]

Rienecker et al.

[11] 4,413,789

[45] Nov. 8, 1983

[54] ROTOR FOR A PULPER

[75] Inventors: Reimund Rienecker, Heidenheim-Mergelstetten; Walter Stricker, Aalen, both of Fed. Rep. of Germany

[73] Assignee: J. M. Voith GmbH, Fed. Rep. of Germany

[21] Appl. No.: 284,407

[22] Filed: Jul. 17, 1981

[30] Foreign Application Priority Data

Jul. 17, 1980 [DE] Fed. Rep. of Germany ..... 3027044

[51] Int. Cl.[3] ..... B02C 23/36

[52] U.S. Cl. ..... 241/46.17

[58] Field of Search ..... 241/46 B, 46.11, 46.17, 241/261.1

[56] References Cited

U.S. PATENT DOCUMENTS 3,933,317 1/1976 Rouere ..... 241/261.1 X

FOREIGN PATENT DOCUMENTS 221919 6/1962 Austria ..... 241/46.17

642832 6/1962 Canada ..... 241/46.17

*Primary Examiner*—Charlie T. Moon

*Attorney, Agent, or Firm*—Ostrolenk, Faber, Gerb & Soffen

[57] ABSTRACT

The disclosure concerns a rotor for use in a pulper for forming a pulp suspension through rotation of the rotor in a pulp container. The rotor is generally conically shaped. Around the exterior of the rotor wind a plurality of helical conveyor elements. Each conveyor element includes a flat surface that is oriented obliquely at an acute angle to the axis of the rotor, and the angle of the conveyor element surface with respect to the rotor axis decreases upwardly along the rotor. On the peripheral edge of the conveyor element at the bottom of the rotor, an additional vane is defined which extends outwardly of the conveyor element. The vane is tilted at a different angle to the rotor axis than the conveyor element and is typically more nearly perpendicular to the rotor axis. The outer peripheral edges of the conveyor element and of the additional vane are sharpened to define cutting edges and may be additionally clad.

15 Claims, 5 Drawing Figures

ROTOR FOR A PULPER

BACKGROUND OF THE INVENTION

The present invention relates to a rotor for a pulper for paper-fiber suspensions.

One such rotor is described in German Provisional Patent (Auslegeschrift) No. 12 07 205. In that rotor, the conveyor surface of the vanes in the portion of the rotor close to the bottom of the pulping container is directed approximately parallel to the axis of the rotor and that surface of the vanes in the region far from the bottom is directed approximately perpendicular to the axis of the rotor. This is designed to avoid eddies being produced by this rotor to any substantial extent, which would impair, i.e. reduce, the overall circulation in the container. However, this rotor design has not been fully satisfactory.

SUMMARY OF THE INVENTION

The object of the present invention is to provide a rotor which produces a good circulating action without short circuitings and eddies.

The invention concerns a rotor for a pulper used in forming pulp suspension, e.g. from waste paper. The rotor for the pulper is mounted at the bottom wall of the pulping container. The pulping container is filled with waste paper, or the like, to be pulped and appropriate pulping chemicals and diluting liquids. The rotor is a generally conically shaped body. Its wide bottom end sits at the bottom of the container and the rotor extends up to its narrow tip. There is at least one, and preferably at least two, helically wound conveyor element or screw worm defined on and winding up along the outside of the rotor body from the bottom to the tip. The conveyor element is generally flat in cross-section. It includes a surface, preferably its upper or drive surface that extends out from the rotor body to the peripheral edge. The helix is wound so that upon rotation of the rotor, the pulp material is driven from the bottom to the tip of the rotor body. The conveyor element does not extend straight out, perpendicular to the rotor axis, but is instead inclined upwardly to define an acute angle to the rotor axis, and this acute angle preferably gradually increases moving up toward the tip of the rotor body.

At the bottom end of the rotor, at the beginning of each helix, an additional vane extends a short distance along the length of the helical conveyor element and projects radially outwardly from the peripheral edge of the conveyor element. The additional vane more closely approximates an orientation of being perpendicular to the rotor axis, whereby the conveyor element and the additional vane attached to the conveyor element usually extend out from the rotor body at different tilt angles with respect to the rotor axis. The peripheral edge of the additional vane is sharpened and thereby defines a cutting edge. The peripheral edge of the main conveyor element is also sharpened, whereby the conveyor element and the additional vane define cutting edges for cutting up material within the container, as well as defining surfaces for conveying the material along the rotor in the container. The cutting edges on the periphery of the vane may be defined by additional cladding on the conveyor element and on the additional vane.

Other objects and features of the invention are described below with reference to an embodiment shown in the accompanying drawings.

DESCRIPTION OF THE PREFERRED EMBODIMENT

Figure 1:
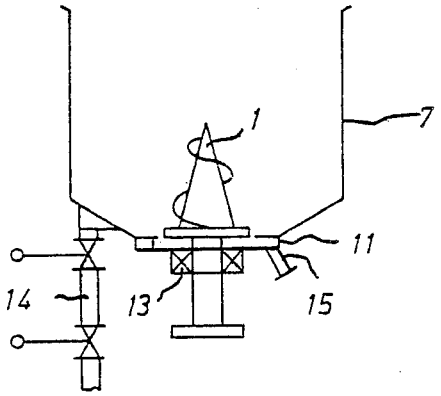
FIG. 1 is a diagrammatic view of an entire pulper in which the rotor of the invention is provided.

Referring to FIG. 1, the pulper includes the container 7 having a bottom wall 11 in which the support or bearing 13 for the rotor 1 is located. The conduit 15 serves for removal of the pulp suspension formed in the container 7, and the conduit 14 is a sluice for the removal of dirt separated from the pulp.

Figure 2:
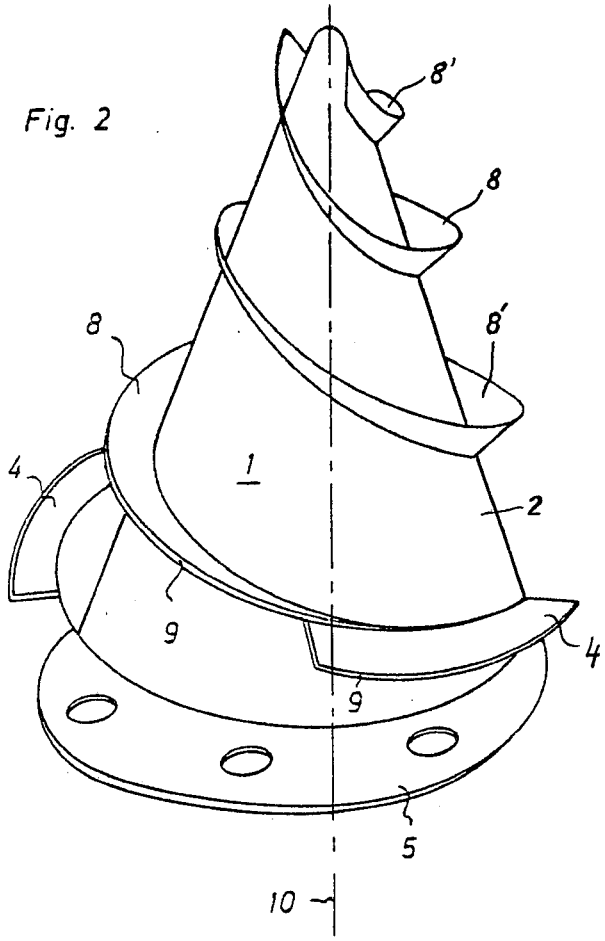
FIG. 2 is an elevational view of the rotor of the invention.

Referring to FIG. 2, the rotor 1 has a conically shaped body 2. The rotor 1 carries an annular bottom plate 5 which is located in the vicinity of the bottom wall 11 of the container. The axis of rotation 10 of the rotor is approximately perpendicular to the container bottom wall 11. The rotor body 2 has two separate, helical, worm-like conveyor elements or vanes 8 and 8' that each wrap around the rotor upwardly therealong. They are angularly offset from each other around the rotor, and both wind in the same direction, whereby their helical paths alternate up along the body 2. They wind so as to urge material up along the rotor as the rotor rotates. The vanes 8 and 8' project from the surface of the rotor body 2 at an incline with respect to the rotor axis 10. The tilt of the vanes gradually increases, moving up the height of the rotor toward its tip. The vanes 8, 8' are arranged oblique to the rotor axis 10 forming a relatively large acute angle at the bottom of the rotor body, while at the tip of the cone, these vanes incline at a greater acute angle with respect to the rotor axis. The spacing of the coils of the helices along the cone remains constant toward the tip of the cone.

In the vicinity of the bottom 5 of the rotor, each helical conveyor element 8, 8' is provided with an extra vane or appendage 4 by which the conveyor element 8, 8' is extended radially outwardly. The appendage is an integral extension from the radially outer edge of the respective helical vane 8, 8'. The vanes 8, 8' are inclined to the rotor axis while their respective appendages 4 extend approximately perpendicular to the axis 10 of the rotor. The deviation of the appendages from being perpendicular to the axis 10 could amount to a maximum of about 15° in both directions, up or down. The conveyor elements 8, 8' could also be aligned approximately parallel to the rotor axis 10 in the region of the bottom plate 5. Accordingly, the offset of the appendages from the respective conveyor element vanes 8, 8' is usually in the range of at least about 45° and at most about 105°.

The appendages 4 act practically as guide vanes, and serve to prevent short circuiting in their region, i.e., in the vicinity of the container bottom 11 the suspension is also conveyed along a pathway that parallels the container bottom, without any substantial part of the suspension being deflected directly back to the corresponding conveyor element. As a result, fully distributed suspension circulates within the container 7. The direction of rotation is in this case clockwise, i.e. it corresponds to the upwardly directed pitch of the helices.

Figure 3A:
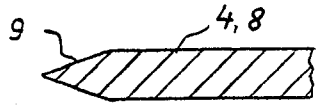
FIGS. 3*a* to 3*c* are radial sections through various embodiments of conveyor elements or additional vanes used on the rotor.
Figure 3B:
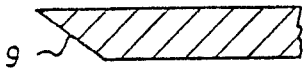
Figure 3C:
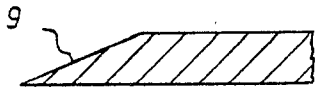

FIG. 3 shows a cross-section through a vane 8, 8' along the radial direction and also through an appendage 4 on the vane. The exposed circumferential edges 9 of the appendages 4 and of the conveyor elements 8 are narrowed or sharpened. FIGS. 3, 3*b* and 3*c* show three different possible sharpened shapes.

Cutting edges of wear-proof material are applied, for instance by cladding to the circumferential edge 9 of the appendages 4 for providing the sharpened edges. As the rotor rotates, its conveyor elements circulate the suspension while its cutting edges cut up and thus help pulp the paper, or the like, being pulped.

The invention permits a surprisingly large decrease in power consumption. Contrary to an assumption that notching of the circumferential edges of the conveyor elements in the form of sawteeth, or the like, or a development of the edges with spike teeth which protrude outward would result in a more favorable manner of action, the development in accordance with the invention has proven particularly advantageous.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A rotor for a pulper for forming a pulp suspension, wherein the rotor is mounted in the wall of a pulping container, the rotor comprising:

a generally conically shaped rotor body extending from a wider bottom to a narrower tip;

a helically wound conveyor element defined on and winding up along the rotor body from the bottom to the tip, the conveyor element being generally flat and including a surface extending out from the rotor body to a peripheral edge of the conveying element;

an additional vane located in the vicinity of the bottom of the rotor and extending generally radially outward from the peripheral edge of the conveyor element, and extending a short distance along the length of the conveyor element from the end of the conveyor element at the bottom of the rotor; the additional vane being oriented to extend generally close to perpendicular to the axis of the rotor.

2. The rotor of claim 1, wherein the additional vane deviates from being oriented perpendicular to the rotor axis by at most an acute angle.

3. The rotor of claim 1, wherein the conveyor element is oriented to extend obliquely to the axis of the rotor.

4. The rotor of claim 3, wherein the angle of inclination of the conveyor element with respect to the rotor axis gradually changes from a smaller acute angle to a larger angle, whereby the conveyor element changes from being less steeply inclined to more steeply inclined, moving from the bottom of the rotor toward the tip thereof.

5. The rotor of either of claims 1 or 3, wherein the conveyor element is oriented with respect to the rotor axis at a different orientation than the additional vane is oriented with respect to the rotor axis.

6. The rotor of claim 5, wherein the extra vane deviates from being perpendicular to the rotor axis by at most 15°.

7. The rotor of claim 6, wherein the conveyor element deviates from being perpendicular to the rotor axis by at most 30°.

8. The rotor of claim 5, wherein the angle of inclination of the conveyor element with respect to the rotor axis gradually changes from a larger acute angle to a smaller angle, whereby the conveyor element changes from being less steeply inclined to more steeply inclined, moving from the bottom of the rotor toward the tip thereof.

9. The rotor of claim 1, wherein the extra vane deviates from being perpendicular to the rotor axis by at most 15°.

10. The rotor of claim 9, wherein the conveyor element deviates from being perpendicular to the rotor axis by at most 30°.

11. The rotor of claim 1, wherein the additional vane comprises a metal plate.

12. The rotor of claim 1, wherein the additional vane has a peripheral edge that tapers to a sharpened edge thereof.

13. The rotor of claim 12, wherein the peripheral edge of the conveyor element tapers to a sharpened edge.

14. The rotor of claim 1, wherein there are a plurality of the helical conveyor elements defined on the rotor, with each conveyor element beginning at a circumferential position that is spaced from the other conveyor element.

15. The rotor of claim 14, wherein the conveyor element helices wind in the same direction from the rotor bottom to the rotor tip.

* * * * *